US005203186A

United States Patent [19]

Zafiroglu

[11] Patent Number: 5,203,186

[45] Date of Patent: Apr. 20, 1993

[54] STITCH-STABILIZED NONWOVEN FABRIC

[75] Inventor: Dimitri P. Zafiroglu, Wilmington, Del.

[73] Assignee: E. I. Du Pont de Nemours and Company, Wilmington, Del.

[21] Appl. No.: 584,161

[22] Filed: Sep. 18, 1990

Related U.S. Application Data

[63] Continuation-in-part of Ser. No. 406,576, Sep. 13, 1989, abandoned.

[51] Int. Cl.[5] ..... D04B 23/08

[52] U.S. Cl. ..... 66/192; 28/158; 112/438; 428/102

[58] Field of Search ..... 66/192; 28/158; 112/438, 439, 429, 430, 413, 414; 428/102, 105

[56] References Cited

U.S. PATENT DOCUMENTS

| | | | |
|---|---|---|---|
| 3,071,165 | 1/1963 | Truslow et al. | 28/158 X |
| 3,260,640 | 7/1966 | Owen | 112/438 |
| 3,274,805 | 9/1966 | Duhl | 66/192 |
| 3,329,552 | 7/1967 | Hughes | 66/192 |
| 3,649,428 | 2/1972 | Hughes | 161/56 |
| 3,717,150 | 2/1973 | Schwartz | 66/192 |
| 3,769,815 | 11/1973 | Ploch et al. | 66/85 |
| 4,298,643 | 11/1981 | Miyagawa et al. | 66/192 |
| 4,306,429 | 12/1981 | Warsop | 66/193 |
| 4,606,964 | 8/1986 | Wideman | 428/152 |
| 4,657,802 | 4/1987 | Morman | 428/152 |
| 4,682,480 | 7/1987 | Schnegg et al. . | |
| 4,704,321 | 11/1987 | Zafiroglu | 66/192 |
| 4,773,238 | 9/1988 | Zafiroglu | 66/192 |
| 4,876,128 | 10/1989 | Zafiroglu | 62/192 |

FOREIGN PATENT DOCUMENTS

| | | |
|---|---|---|
| 0303497 | 8/1988 | European Pat. Off. . |
| 0197119 | 12/1988 | European Pat. Off. . |
| 1162781 | 1/1968 | United Kingdom . |
| 1267945 | 4/1969 | United Kingdom . |
| 2175619A | 12/1986 | United Kingdom . |
| 2209353 | 8/1988 | United Kingdom . |

OTHER PUBLICATIONS

K. W. Bahlo, "New Fabrics without Weaving" Papers of the American Association of Textile Technology, Inc., pp. 51-54 (Nov., 1965).

Product Licensing Index, Research Disclosure, "Stitch bonded products of continuous filament nonwoven webs", p. 30 (Jun., 1968).

Krcma, Manual of Non Wovens, Textile Trade Press, Manchester, (1971) p. 243.

*Primary Examiner*—Andrew M. Falik
*Assistant Examiner*—John J. Calvert

[57] ABSTRACT

A stitchbonded nonwoven fabric which comprises a fibrous layer is reinforced in a first direction with bulkable thread and in a second direction with substantially inextensible thread, the reinforcing directions being at an angle of at least 50 degrees with each other, exhibits superior strength, resistance to splitting and repeated washability.

14 Claims, 2 Drawing Sheets

STITCH-STABILIZED NONWOVEN FABRIC

REFERENCE TO RELATED APPLICATION

This is a continuation-in-part of application Ser. No. 07/406,576, filed Sep. 13, 1989,which is now abandoned.

BACKGROUND OF THE INVENTION

Field of the Invention

This invention relates to a stitchbonded nonwoven fabric and a process for producing it by multi-needle stitching a nonwoven fibrous layer with two thread systems. More particularly, the invention concerns such a fabric and process for making it wherein one of the thread systems is a bulkable thread, the other is a substantially inextensible thread, and the threads are arranged in repeating patterns to form a drapable, durable, soft nonwoven fabric that is strong in both the longitudinal and transverse directions.

Description of the Prior Art

Nonwoven fabrics have long been used in a variety of applications. Unbonded, (i.e., not bonded) nonwoven fabrics most often have been used in applications that require little strength and durability. Such unbonded fabrics generally lack surface stability and often come apart when washed or laundered. To strengthen such fabrics, support layers often have been combined with the unbonded fabric. Strength has also been improved by bonding the fabric with a resin binder or binder fibers incorporated in the fabric. In addition to strengthening the fabric, bonding improves fabric stability and durability. However, bonding also makes the fabric stiff and boardy. Multi-needle stitching (i.e., stitchbonding) of unbonded nonwoven fabrics has also been used to increase fabric strength mainly in the direction of the stitching.

Use of bonded and unbonded, bulked nonwoven fabrics in disposable swim wear, towels, wash cloths, training pants for infants, baby wipes, scouring pads, mattresses, cushions, sleeping bags and the like has been disclosed, for example, by Wideman, U.S. Pat. No. 4,606,964. Morman, U.S. Pat. No. 4,657,802, column 1, line 30, through Column 4, line 32, discloses a large number of elastic nonwoven webs for use as diaper components, filters, bandages, wearing apparel, and the like. Neither patent mentions stitchbonded fabrics.

Multi-needle stitching machines, such as "Arachne", "Liba", or "Mali" machines (including Malimo, Malipol and Maliwatt machines) have been used to insert stitches into a wide variety of fibrous substrates. Such machines and some of the fabrics produced therewith are disclosed by K. W. Bahlo, "New Fabrics Without Weaving", Papers of the American Association of Textile Technology, Inc., pages 51–54 (November, 1965). Other disclosures of the use of such machines appear for example, in Ploch et al, U.S. Pat. No. 3,769,815, Hughes, U.S. Pat. No. 3,649,428 and Product Licensing Index, Research Disclosure, "Stitchbonded products of continuous filament nonwoven webs", page 30 (June, 1968). Warsop, U.S. Pat. No. 4,306,429, discloses a novel stitchbonded fleece made with incompletely threaded front and back bars of a multi-needle stitching machine. Hughes, U.S. Pat. Nos. 3,329,552 and 3,649,428, disclose other stitchbonded fabrics made with two thread systems. However, none of these disclosures concern stitching of a nonwoven fibrous layer with bulkable thread.

Multi-needle stitching of nonwoven fibrous layers with elastic thread (a type of bulkable thread) on one-bar stitchbonding machines is disclosed by Zafiroglu, U.S. Pat. No. 4,773,238, to make dust cloths.

Although each of the aforementioned nonwoven fabrics have been used with some success, their utility could be significantly enhanced by improvements in their combination of strength, softness, washability and durability properties. An object of this invention is to provide such an improvement.

SUMMARY OF THE INVENTION

The present invention provides a stitchbonded nonwoven fabric made with two thread systems. The fabric comprises a nonwoven fibrous layer that is reinforced in a first direction with a bulkable thread which forms spaced-apart rows of stitches in the fibrous layer and is reinforced with substantially inextensible thread in a second direction which is at an angle of greater than 50 degrees with the first direction. The bulkable and the substantially inextensible threads are each multi-needle stitched through the nonwoven fibrous layer. In one embodiment of the invention, the reinforcement in the second direction is provided by inlay stitches Usually, the weight of the threads amounts to no more than 20% of the total weight of the nonwoven fabric, but for economy, often 2 to 10%, and sometimes as little as 3 to 5%. Suitable bulkable thread includes textured thread of polyester, nylon, polypropylene, or the like, and composite thread such as elastomeric yarn (e.g., spandex) in an extended state wrapped with inelastic nylon or polyester. Usually, the stitchbonded nonwoven fabric has a unit weight in the range of 10 to 300 grams per square meter, preferably 20 to 200 g/m2 The row spacing usually is in the range of 2 to 10 rows per centimeter, preferably 3 to 6 per cm. The stitch spacing usually is in the range of 2 to 15 stitches/cm, preferably 4 to 12 per cm.

Bulking of the bulkable threads (a) increases entanglement of the threads with the fibrous layer and enhances fabric stability and durability, and (b) causes gathering of the fabric, which results in a softer hand, improved drape, and decreased stiffness.

The present invention also provides a process for making the above-described stitchbonded nonwoven fabric. In accordance with the process, a fibrous layer, weighing in the range of 15 to 150 grams per square meter, is fed to a multi-needle stitching machine equipped with a two-thread system. The first thread system is a bulkable thread which is stitched into the fibrous layer in parallel rows of stitches at a spacing in the range of 2 to 8 rows per centimeter and with the stitches within each row having a spacing in the range of 1 to 7 stitches per centimeter, preferably 2 to 5 per cm. The bulkable thread is stitched under sufficient tension so that, if the bulkable thread is a textured yarn, the textured yarn is essentially straight and, if the bulkable thread is wrapped elastomeric yarn, the wrapping thread is essentially straight. The bulkable yarn reinforces the fabric in a first direction. The second thread system is a substantially inextensible thread that is incorporated to provide reinforcement in a second direction which forms an angle of greater than 50 degrees with the first reinforcing direction. The inextensible thread can be incorporated by stitching within the same ranges of the row spacing and stitch spacing as in the first thread system. In other embodiments of the process, the inextensible thread, is formed as inlay stitches In each embodiment of the process, the stitching thread is under sufficient tension to maintain, after stitching, its original length. After the stitching operation, tension on the stitching threads is released, the bulkable threads are bulked and the area of the fabric is thereby reduced by 5 to 80%.

BRIEF DESCRIPTION OF THE DRAWINGS

The invention will be readily understood by reference to the drawings in which.

DETAILED DESCRIPTION OF PREFERRED EMBODIMENTS

Figure 1:
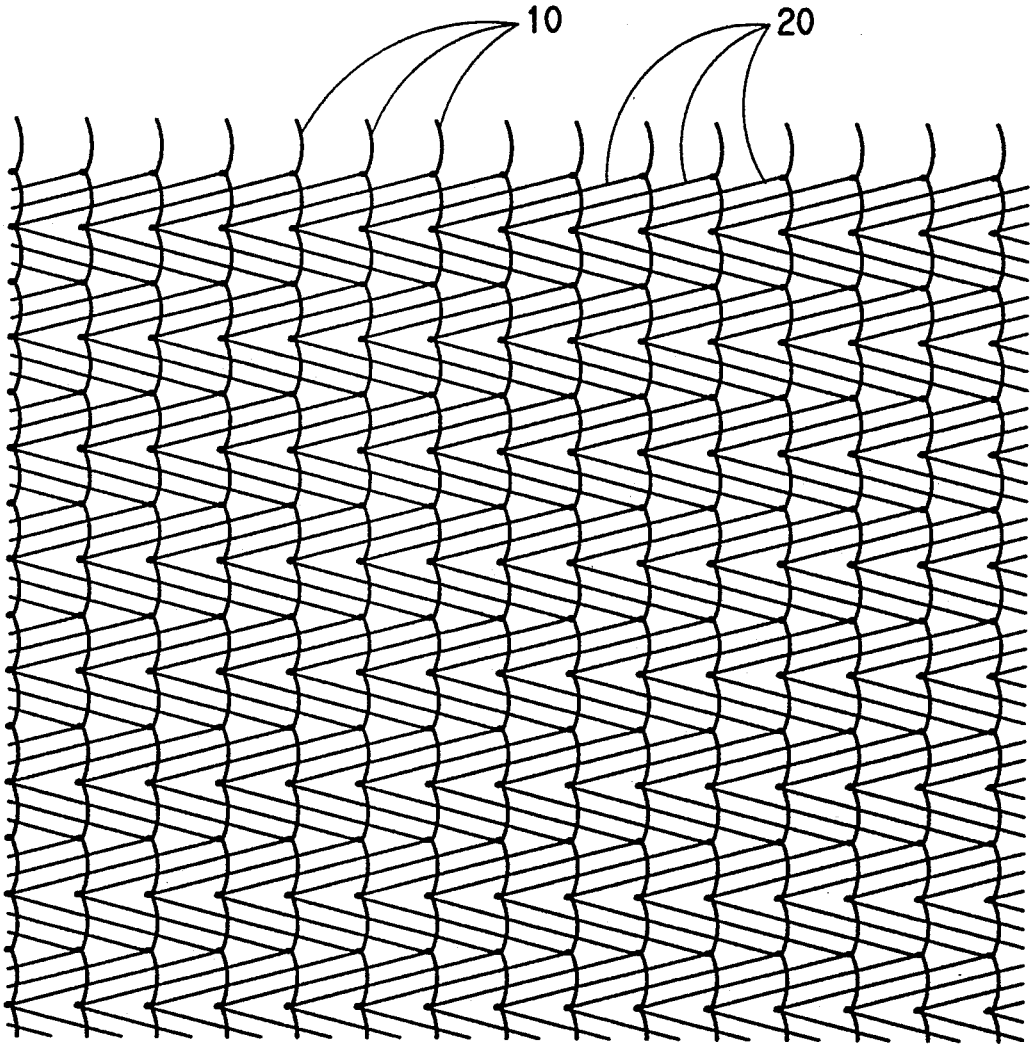
FIG. 1 is a diagrammatic representation of a fabric of the invention made by multi-needle stitching into a nonwoven fibrous layer (not shown) chain stitches of bulkable threads 10 and 1-0,3-4 "tricot" stitches of substantially inextensible threads 20.

The invention will now be described in detail with regard to a preferred stitchbonded fabric of the invention. The fabric is made from a fibrous layer and two thread systems, one thread system being of bulkable thread which provides reinforcement in a first direction, and the second thread system being of substantially inextensible thread which provides reinforcement in a second direction that is at an angle of at least 50 degrees with the first reinforcement direction.

Various starting fibrous layers are suitable for use in the present invention, such as batts of carded fibers, air-laid fiber batts, wood-pulp papers, lightly bonded and unbonded nonwoven sheets, and the like. The term "fiber", as applied to the fibrous layer, means staple fibers of textile denier, pulps, fibrids and the like. The fibers can be natural fibers or of synthetic organic polymer. The fibrous layer batts or sheets usually are supplied in wound-up rolls. If heavier fabrics are desired, two or more batts or sheets can be positioned upon each other to form the fibrous layer for subsequent stitching. However, a single batt or sheet is preferred for easier processing and lower cost.

As used herein, the term "bulkable thread" refers to a thread or yarn which is "bulked" by being deformed out-of plane. The deformation is induced by releasing tension from the thread or by exposing the thread to chemical action, moisture and/or heat at a temperature of about 50 to 200° C.

The term "gathered" is used herein to describe the surface of the stitchbonded nonwoven fabric of the invention and to indicate that the final fabric area is no more than 95% of area of the fibrous layer from which it was made, (that is, the area before the fibrous layer was multi-needle stitched and/or bulked).

In accordance with the process of the present invention, the stitching operation is performed with a conventional multi-needle stitching ("stitchbonding") machine, equipped to handle two yarn systems. Malimo or Liba stitching machines are particularly useful.

Substantially any strong bulkable thread is suitable as the stitching in the first direction. The bulkable thread provides a force that causes the fibrous layer to contract or gather when the thread is subjected to a bulking treatment (e.g., exposure to moisture, steam, heat, or chemicals).

A particularly preferred bulkable thread is formed from spandex elastomeric yarn of high elongation and retractive power which has been wrapped with an inelastic, substantially inextensible yarn. Such threads are available commercially. The bulkable thread is stitched into the sheet under substantial tension so that the substantially inextensible wrapping yarn is straight and so that the bulkable thread will retract during the bulking step to as little as 20 percent of its original length after bulking.

Any substantially inextensible thread can be used for stitching in the second direction. Inextensible threads of nylon or polyethylene terephthalate are preferred. The substantially inextensible thread adds strength to the fabric in a direction that is at an angle of at least 50 degrees to the reinforcing direction of the bulkable thread stitching. The substantially inextensible thread is substantially inextensible while being stitched and its length is not be substantially increased after stitching. However, the substantially inextensible thread can be a bulkable thread which is substantially inextensible during the stitching but then retracts and becomes shorter and as a result is extensible after bulking. A preferred bulkable thread used in the capacity of a substantially inextensible thread is the aforementioned elastomeric yarn wrapped with inextensible yarn and stitched under tension sufficient to straighten the wrapping yarn.

Usually the threads supplied by the two thread systems amount to no more than 20% of the weight of the stitchbonded fabric. For economy however, the weight of stitching thread often amounts to only 2 to 10% of the total fabric weight and sometimes as little as 3 to 5%.

In a preferred embodiment of the invention, the first system of bulkable thread forms rows of chain stitches in and along the length of the fibrous layer. In another embodiment the bulkable thread forms a series of interlocked loops on one surface of the fibrous layer and a parallel series of zigzag tricot stitches on the other surface. Such rows of stitches are typical of those made by a "Mali" or an "Arachne" or "Liba" multi-needle stitching machine. With regard to area contraction or gathering caused by retraction of the bulkable stitching, chain stitches cause almost all gathering to be in the longitudinal direction of the stitched layer and tricot stitches cause gathering across the width as well as along the length of the fabric.

In accordance with the invention, the second thread system provides multi-needle stitching and reinforcement in the second direction with substantially inextensible thread. The thread forms chain stitches, tricot stitches, inlay stitches or any other commonly used stitching, with the proviso that the angle between reinforcing directions of the bulkable and inextensible threads is at an angle of at least 50 degrees.

In the manufacture of nonwoven fibrous layers used as starting materials for the stitchbonded fabrics of the invention, more strength is usually developed in the longitudinal (machine or "MD") direction than in the transverse (cross-machine or "XD") direction. For the stitchbonded fabrics of the present invention, it is advantageous to arrange the bulkable threads in the stronger or longitudinal direction and the substantially inextensible threads in the weaker or transverse direction. Reference herein to a first direction generally means the longitudinal direction ("MD") and reference to a second direction generally means the transverse direction, although such is not required.

The rows of stitches generally have a spacing in the range of 1 to 7 stitches per cm, preferably 2 to 5. Chain stitching with bulkable thread is preferred in the first direction thread and "tricot" stitching with 1 substantially inextensible thread is preferred in the second direction.

With reference to the drawings attached hereto, note that FIG. 1 represents a stitchbonded fabric of the invention in which bulkable thread 10 is in the form of chain stitching in the strong direction of the starting nonwoven fibrous layer and inextensible thread 20 is in the form of 1-0,3-4 "3-across tricot" stitching in the weak direction of the nonwoven fibrous layer. The angle between the reinforcing directions of the two thread systems is greater than 50 degrees. (The method of determining the angle is given hereinafter with regard to FIG. 3.) For the fabric represented in FIG. 1, the angle would be at least 72 degrees, if the stitch spacing and needle spacing were equal.

Usually, the inextensible threads are stitched, laid in or arrayed in the transverse (i.e., the usually weaker) direction of the fibrous nonwoven layer. In some instances however, for example, when the fibrous layer is formed by crosslapping, the transverse direction may be the strong direction of the fabric. Under such circumstances, it is often preferable to use the bulkable thread in the transverse direction to apply tricot or other patterned stitches.

Fabric characteristics and properties are measured by the following procedures.

Unit weight of the starting fibrous layer and of the final stitchbonded fabric are measured in accordance with ASTM D 3776-79. The weight of thread per unit area of fabric is determined by removing and weighing the thread from a given area of fabric.

Fabric weight is determined by weighing a known area of sheet which was cut while it was flattened between plates.

Percent area gather of a fabric is determined measuring its dry area, before ($A_i$) and after ($A_g$) the fabric has been wetted thoroughly with water. Drying is performed at 250of for 10 minutes. The wetting and drying treatment causes the fabric to gather. Percent area gather, %G, is then calculated by the formula $$\%G = 100\,(A_i - A_g)/A_i.$$

Washability is determined by exposing a fabric sample to repeated washing and drying cycles in a home laundry automatic washer and tumble dryer and when applicable, recording the total number of cycles until failure (i.e., until the samples show tears, holes, or other signs of disintegration, or more than 5% weight loss). The washing and drying is conducted in accordance with AATCC Test Method 135-1978 for washing and tumble drying. "AATCC" is the American Association of Textile Chemists and Colorists.

Grab strengths are measured at 70of and 65% relative humidity using an Instron tensile testing machine. Grab strength is determined in general accordance with ASTM Method D-1117-80, on a 4-inch (10.2 cm) wide by 6-inch (15.2 cm) long sample. A gauge length of 3 inches (7.6 cm), clamps having 1-inch (2.5 cm) wide jaws, and an elongation rate of 12 inches (30.5 cm) per minute are used. The grab strength is reported in pounds force. For each reported measurement, ten determinations were made in the machine direction (MD) of the fabric and ten were made in the transverse direction (TD) (i.e., perpendicular to the MD). The average of the MD and the TD measurements are reported separately. Grab strengths were measured for wet (i.e., after being thoroughly soaked in water) and dry samples (a) as made, (b) after one washing and (c) after five washings. The washing and drying were conducted in the same equipment as was used for the washability test.

The "hand split" test is a subjective evaluation of the handling strength of a fabric. The fabric to be tested is pressed on a smooth, flat surface with two thumbs touching and the thumbs are repeatedly drawn apart in an attempt to cause the fabric to split. If the fabric splits without stitching thread breakage, the fabric fails the test. If the fabric cannot be split without breaking the stitching thread, the fabric passes the test.

The angle at which the direction spaced apart rows of stitches formed by the first thread system intersects the second direction of the spaced apart rows formed by the second thread system, can be determined by plane geometry from the stitch diagrams of the two thread systems. The angles can also be determined by simple geometry by examining the straight line segments of the threads between courses with the fabric held in an extended (but not deformed) condition. The direction of the spaced apart rows is the direction that the straight line portions of the threads travel in proceeding between successive courses. In warp knitting, these straight line segments are often referred to as the "floats" of the stitches. To illustrate the determination, FIG. 3 shows an intersection between vertical floats 10 of chain stitches falling along the longitudinal axis (MD) of a fabric of the invention and floats 20 of the second thread system of that fabric. The float and reinforcing directions coincide with each other. The angles formed between the two directions of floats are "a" and "b" and the angle that the floats make with the transverse direction (TD) is "c". The present invention requires that the angle between the directions the two thread systems be greater than 50 degrees. Thus, the angle "a" and "b" each must be greater than 50°. As shown in this illustration, the angles are calculated in degrees by the relationships:

$$a = 90 - c\ 90 - 14.5 = 75.5$$

$$b = 90 + c\ 90 + 14.5 = 104.5$$

$$c = tan^{-1}\,(L/nS)$$

wherein

L is the spacing between successive courses of stitches (or the reciprocal of the number of stitches per unit length in the fabric direction inserted by the machine), S is the spacing between rows of stitches is (equal to the needle spacing, or reciprocal of the gage of the multi-needle stitching machine), and n is the number of needle spaces traversed by the second thread system in proceeding between successive courses.

EXAMPLES

The following examples illustrate the preparation of multi-needle stitched nonwoven fabrics in accordance with the invention and compare them to similar multi-needle stitched nonwoven fabrics which are outside the invention. In the Examples, samples of the invention are designated with Arabic numerals; comparison samples have an upper case letter in their designations.

Several types of fibrous starting layers are used to prepare the fabrics described in each example. The fibrous layers range from the weakest and least durable wood-pulp paper of Example 1 which falls apart when soaked in water, to the fairly strong and durable, but not washable and launderable, point-bonded web of a blend of staple fibers of Example 5. Further specific details of the fibrous layers are given in each example.

In the examples, all the stitched samples and comparisons, bulkable threads were multi-needle stitched with a stitch frequency of 11.5 stitches per inch (4.5 per cm) in the first or longitudinal direction (also called "machine direction" or "MD"). In samples and comparisons that were also stitched in a second direction, substantially inextensible threads and a "gage" of 14 stitches per inch (5.5 per centimeter) were employed. The bulkable threads were stitched in a chain stitch and the substantially inextensible threads were "laid-in" stitches or "tricot" stitches with floats traversing one or two or four needle spaces. In the summary tables of the examples, the following designations were used to identify the particular thread systems and stitch patterns.

Thread systems:

I-0. An inextensible, 40-den (44-dtex), 34-filament flat nylon thread.

Y-1. A bulkable, 40-den (44-dtex), 13 filament, textured nylon knitting yarn.

Y-2. A bulkable, 20-den (22-dtex) spandex filament wrapped with 40-den (44-dtex) nylon.

I-1. Same as Y-1, but in extended and substantially inextensible state when stitched.

I-2 Same as V-2, but in extended and substantially inextensible state when stitched Stitch patterns:

P. Pillar stitch (or chain stitch)

T-1. Closed Tricot or 1 and 1 lap, 1-0,1-2

T-2 Closed 2 and 1 lap, 1-0,2-3

T-3. Closed 4 and 1 lap, 1-0,4-5

L-1. "1-across" inlay (0-0,2-2)

L-2. "2-across" inlay (0-0,3-3)

L-3. "4-across" inlay (0-0,5-5)

Figure 2:
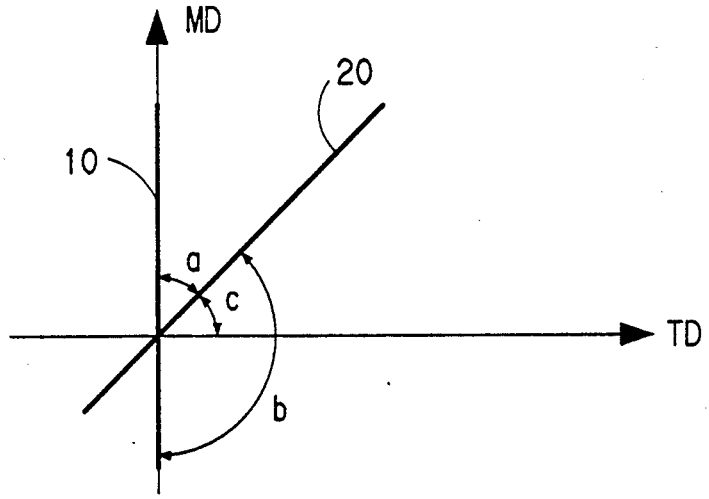
FIG. 2 is a diagram that shows the angles formed by a typical intersection of the reinforcing directions of the two thread systems (i.e., the intersection of the thread portions that are located between successive courses of stitches placed in the fibrous layer).

For each example, a summary table identifies for each sample of the invention and each comparison sample and reports stitching threads and stitch patterns that were used to construct the sample and the percent area gather and minimum angle (a or b of FIG. 2, whichever is smaller) between the reinforcing directions. Each table also reports the measured wet and dry grab strength, hand splittablity, and washability of each sample.

EXAMPLE 1

In this example, two nonwoven fabrics of the invention are made from a fibrous layer of pure pine wood paper pulp containing no binder resins and nominally weighing 1.2 oz/yd$^2$ (40.7 g/m$^2$). The samples of the invention (1-1 and 1-2) are stitchbonded with a two thread system, one of which supplies bulkable thread. The stitchbonded samples are compared to the fibrous layer without stitching (A-1) and with stitchbonding that is outside the invention (A-2, A-3). This example demonstrates the extraordinary strength that is added to ordinary paper (that usually falls apart when simply immersed in water) after it has been stitchbonded i accordance with the invention. Samples 1-1 and 1-2 of the invention are highly suited for use as wet or dry wipe-cloths. Table 1 below summarizes the preparation of the samples and their resultant properties A-1 through A-3 are comparison samples which lack adequate stitching to stabilize the fabric in accordance with the invention. The 1-across tricot stitching is made with an angle of 39° between the threads of the two directions (i.e., angle alpha between the longitudinal direction of the row of chain stitches with their vertical floats and the float of the tricot stitches, as illustrated in FIG. 1). The 2-across stitching is made with an angle of 59o and the 4-across, with an angle of 73°. Results of the testing are reported in Table 1.

TABLE 1

| | Example 1 | | | | |
|---|---|---|---|---|---|
| | Sample | | | | |
| | A-1 | A-2 | A-3 | 1-1 | 1-2 |
| Fabric Weight, | | | | | |
| oz/yd$^2$ | 1.39 | 1.73 | 2.12 | 2.06 | 2.04 |
| g/m$^2$ | 47.1 | 58.6 | 71.9 | 69.8 | 69.2 |
| First Thread System | None | Y-1 | Y-1 | Y-1 | Y-2 |
| Pattern | — | P | P | P | P |
| Second Thread System | None | None | I-0 | I-0 | I-2 |
| Pattern | — | — | L-1 | L-2 | T-3 |
| Minimum Angle, degrees | — | — | 39 | 59 | 73 |
| Grab Strength, as made | | | | | |
| Dry MD, lb force | 13.3 | 55.0 | 23.7 | 25.3 | 25.4 |
| Newtons | 59 | 245 | 105 | 113 | 113 |
| Dry TD, lb force | 8.5 | 2.5 | 19.6 | 28.8 | 29.4 |
| Newtons | 38 | 11 | 87 | 128 | 131 |
| Wet MD, lb force | 0.5 | 37.4 | 16.4 | 19.2 | 23.6 |
| Newtons | 2.2 | 16.6 | 77 | 85 | 105 |
| Wet TD, lb force | 0 | 0 | 15.8 | 28.2 | 29.2 |
| Newtons | 0 | 0 | 70 | 125 | 130 |
| Hand Split Test | | | | | |
| Wet | FAIL | FAIL | FAIL | PASS | PASS |
| Dry | FAIL | FAIL | FAIL | PASS | PASS |

The superior strength exhibited by the samples stitchbonded according to the invention versus the comparison samples, is evident from the reported grab strengths and hand-splittability results. The comparison samples failed the splittability test; both fabrics of the invention passed. All samples failed the washability test. The short, loose fibers of the unbonded fibrous starting layer are believed to be the source of the failures. However, samples 1-1 and 1 of the invention still made very good reusable dry or wet wipes.

EXAMPLE 2

This example illustrates preparation of nonwoven fabric by multi-needle stitching a fibrous starting layer in the form of a reinforced paper of 1.2 oz/yd$^2$ (40.7 g/m$^2$) made from a mixture of 75 weight % paper pulp and 25% 1.35-den (1.5-dtex), 0.5-inch (1.27-cm) long fibers of polyethylene terephthalate. The construction and measured properties of the samples are summarized in Table 2 below. In contrast to the strength and washability of the samples of the invention 2-1, 2-2 and 2-3, all comparison samples failed to survive more than five washing cycles tests and all failed the hand splittability test. Note that comparison sample B-1 had no stitchbonding threads and B-2 and B-3 each had only one yarn system.

EXAMPLE 3.

This example describes preparation of two stitchbonded samples of the invention (3-1 and 3-2) from a fibrous layer which is a 1.9 oz/yd$^2$ (64.4 g/m2), spunlaced, two-layer reinforced paper, one layer being of pine wood paper pulp and amounting to 60 % of the composite weight and the other layer being of 1.35-den (1.5-dtex), 7/8-inch (2.2-cm) long fibers of polyethylene terephthalate and amounting to 40% of the composite weight. Four comparison samples were also made with the same fibrous layer: C-1 having no stitchbonding; C-2 and C-3 each having but one stitchbonding thread system; and C-4 having two thread systems, one bulkable and one inextensible, a minimum angle between the reinforcing directions of only 39 degrees (versus at least 50 degrees according to the invention). Table 3 summarizes the sample constructions and shows how very well the fabrics of the invention withstand repeated wash cycles, - more than 75 washes for samples of the invention versus fewer than 2 for comparison samples.

TABLE 2

| Example 2 | Sample | | | | | |
|---|---|---|---|---|---|---|
| | B-1 | B-2 | B-3 | 2-1 | 2-2 | 2-3 |
| Fabric Weight, | | | | | | |
| oz/yd$^2$ | 1.23 | 1.65 | 2.0 | 2.1 | 2.1 | 2.1 |
| g/m$^2$ | 41.7 | 55.9 | 67.8 | 71.2 | 71.2 | 71.2 |
| First Thread | none | Y-1 | none | Y-1 | Y-1 | Y-1 |
| Pattern | — | P | — | P | P | P |
| Second Thread | none | none | I-1 | I-0 | I-0 | I-2 |
| Pattern | — | — | T-1 | T-2 | L-3 | T-3 |
| Minimum angle | — | — | — | 59 | 73 | 73 |
| % Area Gather | SD* | 9 | 11 | 13 | 17 | 65 |
| Grab Strengths | | | | | | |
| As made | | | | | | |
| Dry MD, lbs | 6.3 | 23.2 | 25.1 | 30.6 | 25.1 | 25.1 |
| Newtons | 28 | 103 | 112 | 136 | 112 | 112 |
| Dry TD, lb | 5.4 | 1.6 | 3.2 | 20.4 | 33.8 | 24.0 |
| N | 24 | 7 | 14 | 91 | 150 | 107 |
| Wet MD, lb | 3.3 | 18.1 | 22.1 | 29.5 | 24.4 | 21.8 |
| N | 15 | 81 | 98 | 131 | 109 | 97 |
| Wet TD, lb | 3.2 | 1.1 | 2.6 | 20.8 | 28.6 | 32.5 |
| N | 14 | 5 | 12 | 93 | 127 | 127 |
| After 1 wash | | | | | | |
| Dry MD, lb | 5.0 | 18.3 | 23.5 | 35.7 | 22.3 | 24.3 |
| N | 22 | 81 | 105 | 159 | 99 | 109 |
| Dry TD, lb | 3.2 | 2.5 | 11.1 | 35.8 | 29.8 | 43.5 |
| N | 14 | 11 | 49 | 159 | 133 | 194 |
| Wet MD, lb | 3.5 | 16.6 | 19.9 | 35.8 | 20.4 | 20.2 |
| N | 16 | 74 | 89 | 159 | 91 | 90 |
| Wet TD, lb | 2.4 | 1.4 | 4.4 | 26.9 | 28.5 | 32.5 |
| N | 11 | 6 | 20 | 120 | 127 | 145 |
| After 5 washes | | | | | | |
| Dry MD, lb | FW* | FW | 23.0 | 37.8 | 18.1 | 23.2 |
| N | FW | FW | 102 | 168 | 81 | 103 |
| Dry TD, lb | FW | FW | 5.8 | 36.2 | 39.3 | 39.8 |
| N | FW | FW | 26 | 161 | 175 | 177 |
| Wet MD, lb | FW | FW | 16.6 | 37.4 | 15.0 | 24.1 |
| N | FW | FW | 74 | 166 | 67 | 107 |
| Wet TD, lb | FW | FW | 7.6 | 28.3 | 22.6 | 37.3 |
| N | FW | FW | 34 | 126 | 101 | 166 |
| Hand Split Test | | | | | | |
| Wet | Fail | Fail | Fail | Pass | Pass | Pass |
| Dry | Fail | Fail | Fail | Pass | Pass | Pass |
| Number of Washes until failure | 1 | 1-2 | 5 | 55 | 75+ | 75+ |

*Notes:
SD = Sample deteriorated in water.
FW = Failed wash test.

TABLE 3

| Example 3 | Sample | | | | | |
|---|---|---|---|---|---|---|
| | C-1 | C-2 | C-3 | C-4 | 3-1 | 3-2 |
| Fabric Weight, | | | | | | |
| oz/yd$^2$ | 1.9 | 2.2 | 2.3 | 2.6 | 2.4 | 2.4 |
| g/m$^2$ | 64 | 76 | 78 | 88 | 81 | 81 |
| First Thread | none | Y-1 | none | Y-1 | Y-1 | Y-2 |
| Pattern | — | P | — | P | P | P |
| Second Thread | none | none | I-1 | I-0 | I-0 | I-2 |
| Pattern | — | — | T-1 | L-1 | T-2 | T-3 |
| Minimum angle | — | — | — | 39 | 59 | 73 |
| % Area Gather | — | 20 | 17 | 12 | 19 | 69 |
| Grab Strengths | | | | | | |
| As made | | | | | | |
| Dry MD, lbs | 37.2 | 39.9 | 39.4 | 70.5 | 43.0 | 34.9 |
| Newtons | 166 | 177 | 175 | 314 | 191 | 155 |
| Dry TD, lb | 20.1 | 7.3 | 10.2 | 8.4 | 41.0 | 39.0 |
| N | 89 | 32 | 45 | 37 | 182 | 174 |
| Wet MD, lb | 32.1 | 32.7 | 32.3 | 75.9 | 34.8 | 30.0 |
| N | 143 | 146 | 144 | 338 | 155 | 134 |
| Wet TD, lb | 16.2 | 6.5 | 9.8 | 11.3 | 33.0 | 33.8 |
| N | 72 | 29 | 44 | 50 | 147 | 150 |
| After 1 wash | | | | | | |
| Dry MD, lb | FW | FW | 33.2 | FW | 35.6 | 38.2 |
| N | FW | FW | 148 | FW | 158 | 176 |
| Dry TD, lb | FW | FW | 6.5 | FW | 41.7 | 33.5 |
| N | FW | FW | 29 | FW | 186 | 149 |
| Wet MD, lb | FW | FW | 22.7 | FW | 32.3 | 45.4 |
| N | FW | FW | 101 | FW | 144 | 202 |
| Wet TD, lb | FW | FW | 5.4 | FW | 34.9 | 28.1 |
| N | FW | FW | 24 | FW | 155 | 125 |
| After 5 washes | | | | | | |
| Dry MD, lb | FW | FW | FW | FW | 37.6 | 43.1 |
| N | FW | FW | FW | FW | 167 | 192 |
| Dry TD, lb | FW | FW | FW | FW | 41.0 | 33.9 |
| N | FW | FW | FW | FW | 182 | 151 |
| Wet MD, lb | FW | FW | FW | FW | 28.9 | 58.3 |
| N | FW | FW | FW | FW | 129 | 259 |
| Wet TD, lb | FW | FW | FW | FW | 35.7 | 28.1 |
| N | FW | FW | FW | FW | 159 | 125 |
| Hand Split Test | | | | | | |
| Wet | Fail | Fail | Fail | Pass | Pass | Pass |
| Dry | Fail | Fail | Fail | Pass | Pass | Pass |
| Number of Washes until failure | 0 | 0 | 2 | 1 | 75+ | 75+ |

Notes:
— = not measured or inapplicable.
See Table 2 for other notes.

EXAMPLE 4

In this example two stitohbonded samples of the invention (4-1 and 4-2) are prepared with two yarn systems and a 1.2-oz/yd$^2$ (40.7-g/m2) lightly spunlaced web of 7/8-inch (2.2-cm) long, 1.35-den (1.5-dtex)fibers of polyethylene terephthalate. Three comparison samples are also prepared with the same fibrous layer: D-1 which has no stitching; samples D-2 which is stitched with only one yarn system; and D-3 which is stitched with two thread systems that do not provide the minimum angle between the reinforcing directions of the stitching. Table 4, below, which summarizes the sample constructions and measured characteristics, again demonstrates the advantages in strength and repeated washability of the stitchbonded fabrics of the invention over comparison samples.

EXAMPLE 5

This example illustrates the advantages of the invention with stitchbonded fibrous layer which is point-bonded carded web. The web is formed from a blend of 75 weight percent of 1.5-inch (3.8-cm) long, 1.5-den (1.7-dtex) acrylic fibers and 25 % of 3-inch (7.6-cm)

long, 3-den (3.3-dtex) polyester fibers of lower melting temperature than the acrylic fibers. The web was point bonded at 100 psi (689 kPa) and 160° C. with a regular pattern of 625 points per in2 (96.9/cm2), each point having a diameter of 0.020 inch (0.05 mm). Two such samples of the invention, 5-1 and 5-2, are compared with three comparison samples. The comparisons are: E-1, the point-bonded web without stitching; and E-2 and E-3, which are each stitched with only one thread system. Table 5, below, summarizes the construction and properties of the samples and again shows the clear advantages in strength, resistance to splitting and repeated washability of the fabrics of the invention over the comparison samples.

TABLE 4

| | Example 4 | | | | |
|---|---|---|---|---|---|
| | Sample | | | | |
| | D-1 | D-2 | D-3 | 4-1 | 4-2 |
| Fabric Weight, | | | | | |
| oz/yd$^2$ | 1.16 | 1.43 | 1.64 | 1.57 | 1.53 |
| g/m$^2$ | 39.3 | 48.5 | 55.6 | 53.2 | 51.9 |
| First Thread | none | Y-1 | Y-1 | Y-1 | Y-2 |
| Pattern | — | P | P | P | P |
| Second Thread | none | none | I-0 | I-0 | I-2 |
| Pattern | — | — | T-1 | L-2 | T-3 |
| Minimum angle | — | — | 39 | 59 | 73 |
| % Area Gather | — | 14 | 21 | 22 | 72 |
| Grab Strengths | | | | | |
| As made | | | | | |
| Dry MD, lbs | 24.6 | 29.5 | 25.3 | 28.4 | 64.8 |
| Newtons | 109 | 131 | 113 | 126 | 288 |
| Dry TD, lb | 11.3 | 4.0 | 12.9 | 14.2 | 22.4 |
| N | 50 | 18 | 57 | 63 | 100 |
| Wet MD, lb | 18.6 | 29.6 | 29.3 | 23.3 | 56.8 |
| N | 83 | 132 | 130 | 104 | 253 |
| Wet TD, lb | 10.5 | 6.9 | 11.6 | 14.4 | 22.6 |
| N | 47 | 31 | 52 | 64 | 101 |
| After 1 wash | | | | | |
| Dry MD, lb | 20.5 | 22.9 | FW | 18.4 | 64.5 |
| N | 91 | 102 | FW | 82 | 287 |
| Dry TD, lb | 10.8 | 9.4 | FW | 12.6 | 38.2 |
| N | 48 | 42 | FW | 56 | 170 |
| Wet MD, lb | 18.6 | 21.7 | FW | 18.0 | 61.9 |
| N | 83 | 97 | FW | 80 | 275 |
| Wet TD, lb | 9.3 | 8.5 | FW | 12.0 | 33.5 |
| N | 41 | 38 | FW | 53 | 144 |
| After 5 washes | | | | | |
| Dry MD, lb | 18.2 | FW | FW | 19.3 | 68.3 |
| N | 81 | FW | FW | 86 | 304 |
| Dry TD, lb | 11.0 | FW | FW | 15.3 | 38.0 |
| N | 49 | FW | FW | 68 | 169 |
| Wet MD, lb | 19.5 | FW | FW | 19.9 | 62.0 |
| N | 87 | FW | FW | 89 | 276 |
| Wet TD, lb | 9.2 | FW | FW | 13.8 | 33.5 |
| N | 41 | FW | FW | 61 | 149 |
| Hand Split Test | | | | | |
| Wet | Fail | Fail | Fail | Pass | Pass |
| Dry | Fail | Fail | Fail | Pass | Pass |
| Pass | | | | | |
| Number of Washes until failure | 5 | 2 | 2 | 75+ | 75+ |

Notes:
Same as in Table 3.

TABLE 5

| | Example 5 | | | | |
|---|---|---|---|---|---|
| | Sample | | | | |
| | E-1 | E-2 | E-3 | 5-1 | 5-2 |
| Fabric Weight, | | | | | |
| oz/yd$^2$ | 2.1 | 2.4 | 2.5 | 2.7 | 2.6 |
| g/m$^2$ | 71.2 | 81.4 | 84.8 | 91.5 | 88.1 |
| First Thread | none | Y-1 | none | Y-1 | Y-2 |
| Pattern | — | P | — | P | P |
| Second Thread | none | none | I-0 | I-0 | I-2 |

TABLE 5-continued

| | Example 5 | | | | |
|---|---|---|---|---|---|
| | Sample | | | | |
| | E-1 | E-2 | E-3 | 5-1 | 5-2 |
| Pattern | — | — | T-1 | L-3 | T-3 |
| Minimum angle | — | — | — | 73 | 73 |
| % Area Gather | — | 14 | 10 | 18 | 64 |
| Grab Strengths | | | | | |
| As made | | | | | |
| Dry MD, lbs | 13.6 | 20.0 | 10.0 | 34.0 | 36.6 |
| Newtons | 61 | 89 | 89 | 151 | 163 |
| Dry TD, lb | 1.0 | 9.5 | 6.6 | 30.8 | 25.7 |
| N | 4.5 | 42 | 29 | 137 | 114 |
| Wet MD, lb | 12.8 | 19.1 | 15.1 | 29.1 | 32.8 |
| N | 57 | 85 | 67 | 137 | 114 |
| Wet TD, lb | 1.3 | 8.5 | 5.5 | 27.6 | 17.9 |
| N | 5.9 | 38 | 24 | 123 | 146 |
| After 1 wash | | | | | |
| Dry MD, lb | FW | FW | 15.4 | 33.4 | 43.2 |
| N | FW | FW | 69 | 149 | 192 |
| Dry TD, lb | FW | FW | 9.1 | 35.7 | 37.3 |
| N | FW | FW | 40 | 159 | 166 |
| Wet MD, lb | FW | FW | 14.7 | 26.3 | 45.1 |
| N | FW | FW | 65 | 117 | 201 |
| Wet TD, lb | FW | FW | 9.2 | 30.6 | 35.4 |
| N | FW | FW | 41 | 136 | 158 |
| After 5 washes | | | | | |
| Dry MD, lb | FW | FW | FW | 33.0 | 45.2 |
| N | FW | FW | FW | 147 | 201 |
| Dry TD, lb | FW | FW | FW | 37.0 | 37.1 |
| N | FW | FW | FW | 165 | 165 |
| Wet MD, lb | FW | FW | FW | 31.3 | 43.1 |
| N | FW | FW | FW | 139 | 192 |
| Wet TD, lb | FW | FW | FW | 26.3 | 38.2 |
| N | FW | FW | FW | 117 | 170 |
| Hand Split Test | | | | | |
| Wet | fail | fail | fail | pass | pass |
| Dry | fail | fail | fail | pass | pass |
| Number of Washes until failure | 0 | 0 | 2 | 60 | 75+ |

Notes:
Same as in Table 3.

I claim:

1. A stitchbonded nonwoven fabric made with two multi-needle stitched thread systems, the first thread system being a bulkable thread and the second thread system being a substantially inextensible thread, the fabric comprising a nonwoven fibrous layer reinforced in a first direction with the bulkable thread forming spaced-apart rows of stitches in the fibrous layer and reinforced in a second direction with the substantially inextensible thread forming spaced-apart rows of stitches in the fibrous layer, the second direction being at an angle of at least 50 degrees with the first direction.

2. A stitchbonded nonwoven fabric in accordance with claim 1 wherein the fibrous layer comprises staple fibers.

3. A stitchbonded nonwoven fabric made with two multi-needle thread systems, the first thread system being a bulkable thread and the second thread system being a substantially inextensible thread, the fabric comprising a nonwoven fibrous layer reinforced in a first direction with the bulkable thread forming spaced-apart rows of stitches in the fibrous layer and reinforced in a second direction with the substantially inextensible thread forming spaced-apart rows of stitches, the second direction being at an angle of at least 50 degrees with first direction and the reinforcement in the second direction being provided by inlay stitches.

4. A stitchbonded nonwoven fabric in accordance with claim 3 wherein the fibrous layer comprises staple fibers.

5. A stitchbonded nonwoven fabric in accordance with claim 1, 2, 3 or 4 wherein the weight of the threads amounts to no more than 20% of the total weight of the nonwoven fabric.

6. A stitchbonded nonwoven fabric in accordance with claim 5 wherein weight of the threads amounts to 2 to 10% of the total weight of the nonwoven fabric.

7. A stitchbonded nonwoven fabric in accordance with claim 1, 2, 3 and 4 wherein the bulkable thread is a textured thread of polyester, nylon or polypropylene.

8. A stitchbonded nonwoven fabric in accordance with claim 1, 2, 3 or 4 wherein the bulkable thread is an elastomeric yarn in an extended state wrapped with an inelastic yarn.

9. A stitchbonded nonwoven fabric in accordance with claim 8 wherein the elastomeric yarn is spandex and the inelastic yarn is nylon or polyester.

10. A stitchbonded nonwoven fabric in accordance with claim 1, 2, 3 or 4 wherein the bulkable thread and the substantially inextensible thread are the same.

11. A process for making a stitchbonded nonwoven fabric comprising feeding a fibrous layer, weighing in the range of 15 to 150 grams per square meter, to a multi-needle stitching machine equipped with two thread systems, supplying the first thread system with a bulkable thread, multi-needle stitching the bulkable thread into the fibrous layer in parallel rows of stitches at a spacing in the range of 2 to 8 rows per centimeter and with the stitches within each row at a spacing in the range of 1 to 7 stitches per centimeter, the bulkable thread being stitched under sufficient tension to maintain the bulkable thread straight during the stitching, to reinforce the fabric in a first direction, and supplying the second thread system with a substantially inextensible thread, multi-needle stitching the inextensible thread with the fibrous layer to form parallel rows of stitches at a spacing in the range of 2 to 8 rows per centimeter and with stitches within each row at a spacing in the range of 1 to 7 stitches per centimeter, to reinforce the fabric in a second direction, the second direction forming an angle of at least 50 degrees with the first reinforcing direction.

12. A process in accordance with claim 11 wherein the inextensible thread is stitched as inlay stitches.

13. A process in accordance with claim 12 wherein the bulkable yarn forms rows of chain stitches and the inlay stitches are 0,- 5-5 stitches.

14. A process in accordance with claim 11 wherein the tension on the stitched threads is released and the bulkable threads are bulked to cause gathering of the fabric and reduction of the fabric area by 5 to 80%.

* * * * *